US008182226B2

(12) United States Patent
Fu

(10) Patent No.: US 8,182,226 B2
(45) Date of Patent: May 22, 2012

(54) BUILT-IN SWING MECHANISM OF ROTARY FAN

(75) Inventor: Chiao Fu, Tamtzu Hsiang (TW)

(73) Assignee: King Jih Enterprise Corp., Tamtzu Hsiang, Taichung County (TW)

( * ) Notice: Subject to any disclaimer, the term of this patent is extended or adjusted under 35 U.S.C. 154(b) by 985 days.

(21) Appl. No.: 12/171,282

(22) Filed: Jul. 10, 2008

(65) Prior Publication Data

US 2008/0304969 A1 Dec. 11, 2008

Related U.S. Application Data

(63) Continuation-in-part of application No. 11/759,842, filed on Jun. 7, 2007, now Pat. No. 7,771,167.

(51) Int. Cl.
*F04D 25/10* (2006.01)

(52) U.S. Cl. ..... 416/100; 416/170 R; 415/70; 415/126

(58) Field of Classification Search ..... 416/100, 416/170 R; 415/126, 213.1, 70
See application file for complete search history.

(56) References Cited

U.S. PATENT DOCUMENTS 1,551,278 A * 8/1925 Aalborg ..... 74/43
2,050,764 A * 8/1936 Rogers ..... 416/135
2,742,225 A * 4/1956 Guardado ..... 416/100
5,097,674 A * 3/1992 Imaiida et al. ..... 62/259.1

* cited by examiner

*Primary Examiner* — Ninh H Nguyen
(74) *Attorney, Agent, or Firm* — Egbert Law Offices PLLC

(57) ABSTRACT

The present invention provides an improved built-in swing mechanism of a rotary fan. The mechanism includes a ball-and-socket support frame, arranged onto front wall of the main casing corresponding to the axle center of a drive motor and provided with a spherical supporting surface and a through-hole. A spherical abut seat is fastened at a front end of the drive motor is provided with a spherical abut surface that couples with the spherical supporting surface. A punch hole is placed at the center of spherical abut surface for the penetration of the axle center. A crank linkage element is assembled between rear end of the drive motor and the rear wall of the main casing. The first end of the crank linkage element can be driven to enable the oscillation of the second end. The second end is assembled at a rotary pivot corresponding to the main casing.

4 Claims, 10 Drawing Sheets

BUILT-IN SWING MECHANISM OF ROTARY FAN

CROSS-REFERENCE TO RELATED U.S. APPLICATIONS

The present application is a continuation-in-part application under 35 U.S.C. §120 of U.S. Ser. No. 11/759,842, filed on 7 Jun. 2007 and entitled "CONCEALED ROTARY FAN".

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a rotary fan, and more particularly to an innovative rotary fan with a built-in swing mechanism.

2. Description of Related Art Including Information Disclosed Under 37 CFR 1.97 and 37 CFR 1.98

The rotary fan of the present invention refers to a fan that feeds wind through the rotation of a rotary fan.

The currently available rotary fan generally comprises oscillating and cover-rotating types from the angle of wind control. While the rotary vane is rotated, the oscillating fan will drive the headstock to generate oscillating traverse motion for changing automatically the wind direction; however, the oscillating rotary fan shifts reciprocally along a path of the same height, so the area of air outlet cannot be expanded vertically, making it unsuitable to accommodate some operating environments. On the other hand, as the oscillating point of the oscillating rotary fan is located at a lower rear position of the headstock, the outer casing of the rotary vane will shift by a large amplitude, focusing the above-specified oscillating point when the headstock is oscillated, thus leading to an increased area of rotary fan against actual application.

The cover-rotating rotary fan is designed in a manner that the fan casing is provided with a diversion box, so the flow of air outlet could be changed through the rotation of the diversion box. Yet, the diversion effect is realized generally through oblique plates. The oblique surface structure of oblique plates may also impede air flow to a certain degree, thus greatly impairing the air feed performance of the rotary fan and making it more difficult to clean the plates with depressed orifices.

As for large-sized industrial rotary fans, the rotary vane is generally made of a metal plate, and the outer casing is fixed by a stable support structure which compromise the oscillating functions. This will reduce the applicability of the outlet area and increase the probability of manually shifting the rotary fan by the user, leading to possible personal injury arising from contact with sharp rotary vane, especially while operating.

Thus, to overcome the aforementioned problems of the prior art, it would be an advancement in the art to provide an improved structure that can significantly improve efficacy.

Therefore, the inventor has provided the present invention of practicability after deliberate design and evaluation based on years of experience in the production, development and design of related products.

BRIEF SUMMARY OF THE INVENTION

The present invention provides an innovative rotary fan with a built-in swing mechanism. With the help of a drive motor, the rotary fan along with the rotary vane will generate axially oblique circulating oscillation to change automatically the outlet's wind direction. Moreover, the wind direction changes uniquely along a circular path, making it possible to increase the wind outlet surface at any direction, and meet customer demands with improved applicability.

When the drive motor along with the axle center generates axially oblique circulating oscillation with the help of drive motor, the front end of the drive motor can be abutted with the spherical abut surface of the spherical abut seat. Then, the front end mates with the spherical supporting surface of the ball-and-socket support frame for a universally stable support. This allows the drive motor and rotary vane to oscillate more stably and efficiently with little noise.

Bulges and troughs are arranged at intervals between spherical abut surface of the spherical abut seat and spherical supporting surface of the ball-and-socket support frame. The spherical abut seat can oscillate universally within the spherical supporting surface. Moreover, adequate limitation effects could be achieved through embedding of bulges and troughs. Since the vibration generated from the rotation of axle center could also drive the displacement of drive motor, a limitation effect could be achieved through embedding of bulges and troughs.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
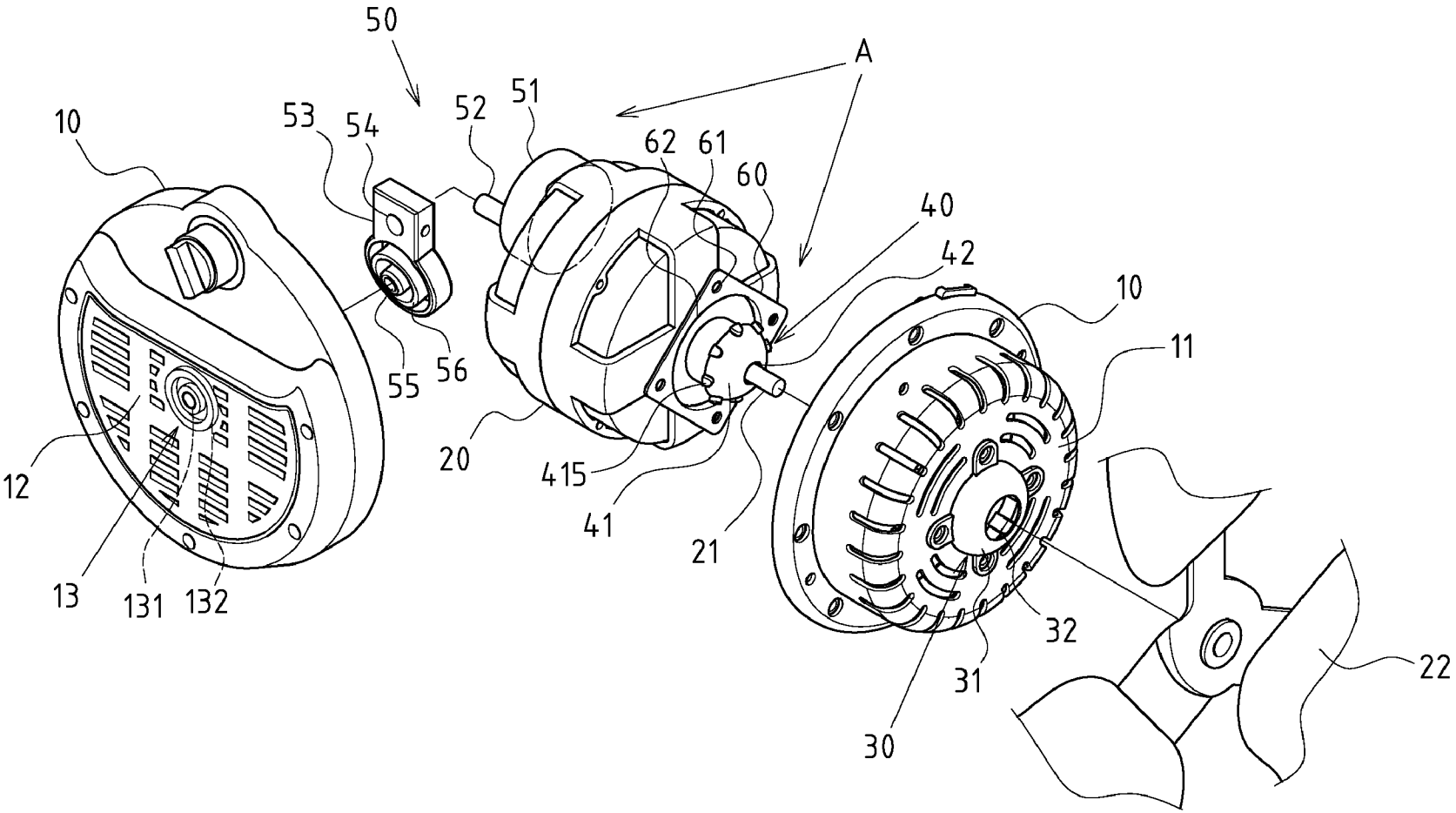
FIG. 1 depicts an exploded perspective view of a partial component of the present invention.
Figure 2:
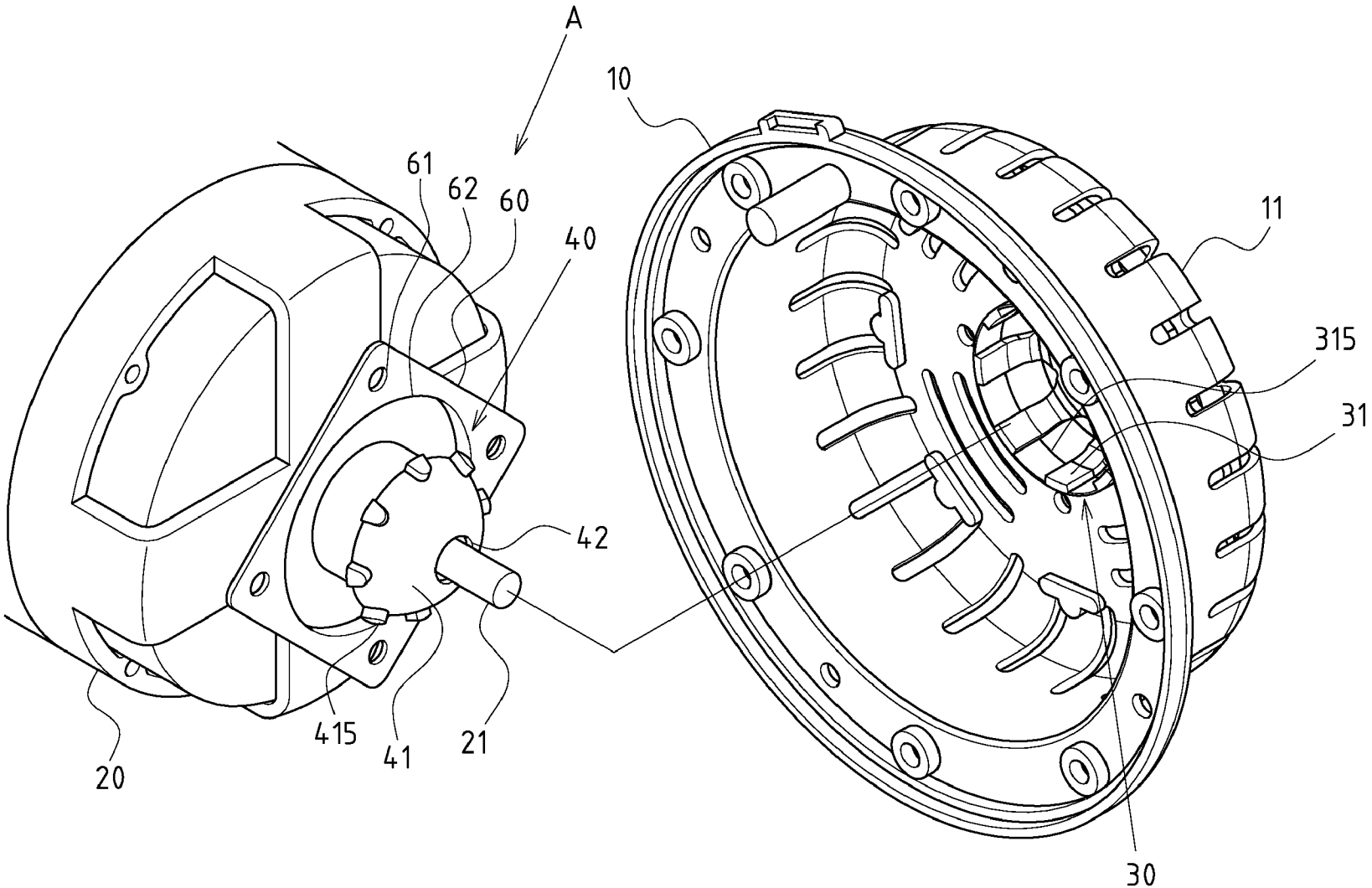
FIG. 2 depicts an exploded perspective view of the spherical abut seat and ball-and-socket support frame of the present invention.
Figure 3:
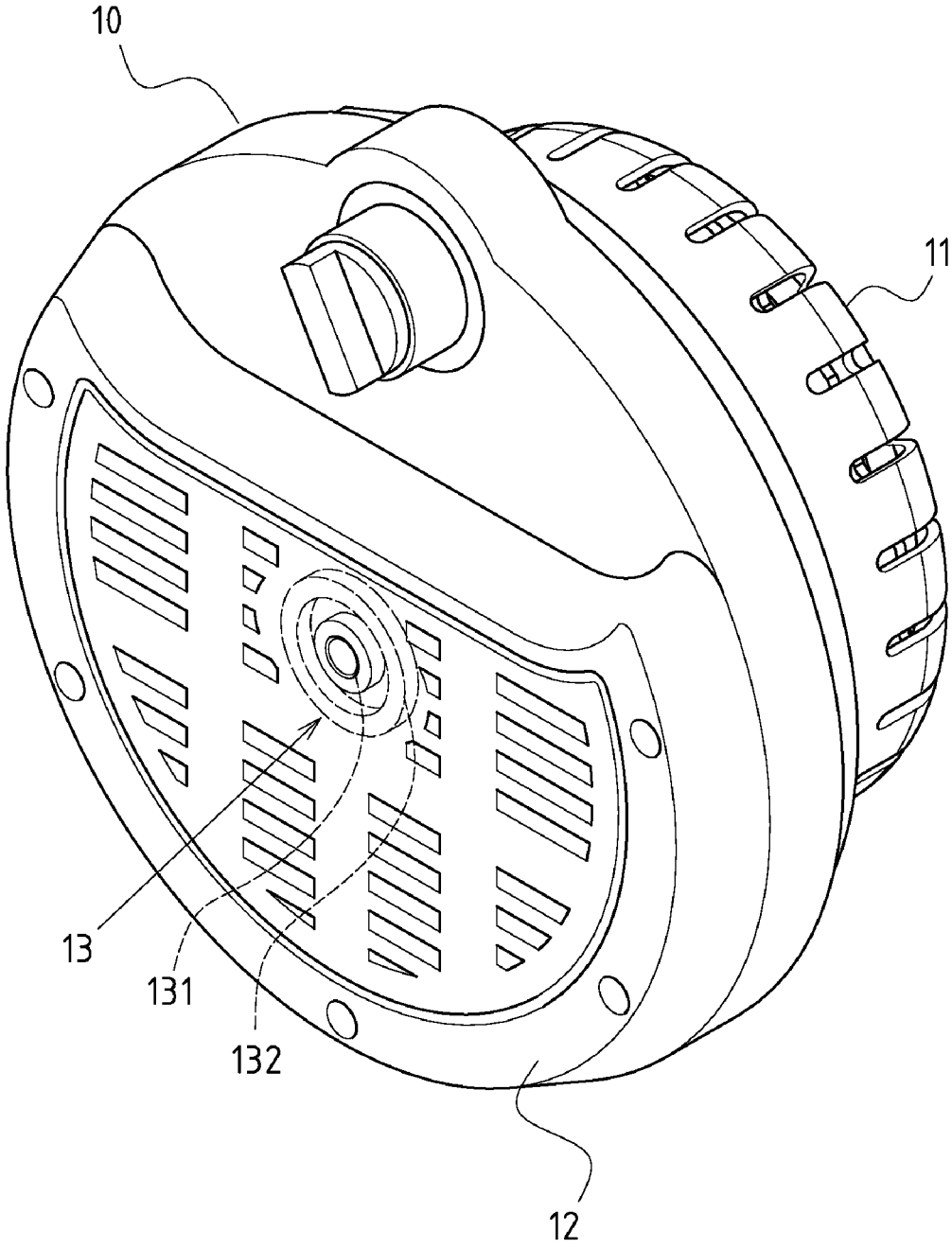
FIG. 3 depicts an assembled perspective view of the main casing of the present invention.

The features and the advantages of the present invention will be more readily understood upon a thoughtful deliberation of the following detailed description of a preferred embodiment of the present invention with reference to the accompanying drawings.

FIGS. 1-4 depict preferred embodiments of the built-in swing mechanism of rotary fan of the present invention. The embodiments are provided only for explanatory purposes with respect to the patent claims.

The built-in swing mechanism A is placed within the main casing 10 of a rotary fan B, so that the axle center 21 of drive motor 20 along with the rotary vane 22 is driven to generate axially oblique circulating oscillation.

This built-in swing mechanism A includes a ball-and-socket support frame 30, arranged onto front wall 11 of the main casing 10 correspondingly to the axle center 21 of drive motor 20. The ball-and-socket support frame 30 is provided with a spherical supporting surface 31, and a through-hole 32 located at center of the spherical supporting surface 31. The through-hole 32 is used for threading of the axle center 21 of the drive motor 20.

The built-in swing mechanism A also includes a spherical abut seat 40, fastened at front end of the drive motor 20. The spherical abut seat 40 is provided with a spherical abut surface 41 that couples with the spherical supporting surface 31 of the ball-and-socket support frame 30. A punch hole 42 is placed at the center of spherical abut surface 41 for the penetration of the axle center 21 of the drive motor 20.

The built-in swing mechanism A further includes a crank linkage element 50, assembled between rear end of the drive motor 20 and the rear wall 12 of the main casing 10. The first end of the crank linkage element 50 can be driven to enable the oscillation of the second end. The second end is assembled at a rotary pivot 13 corresponding to the rear wall 12 of the main casing 10. In this preferred embodiment, the first end of the crank linkage element 50 comprises an independent motor gearbox 51, which is provided with an output shaft 52. The second end of the crank linkage element 50 comprises a laterally protruding drive plate 53, one end of which is provided with an axle hole 54 for sleeving at the output shaft 52 of the motor gearbox 51, and the other end of which is provided with a protruding column 55 and a sleeving ring 56, such that the rotary pivot 13 on the rear wall 12 of the main casing 10 is provided with a mating pivot seat hole 131 and a circular groove 132.

Bulges 415 and troughs 315 are arranged at intervals between spherical abut surface 41 of the spherical abut seat 40 and spherical supporting surface 31 of the ball-and-socket support frame 30. The bulges 415 and troughs 315 are embedded together, and the width of a bulge 415 is smaller than that of a trough 315, so that the spherical abut seat 40 can oscillate universally within the spherical supporting surface 31. Moreover, adequate limitation effects could be achieved through embedding of bulges 415 and troughs 315. Since the vibration generated from the rotation of axle center 21 could also drive the displacement of drive motor 20, a limitation effect could be achieved through embedding of bulges 415 and troughs 315.

Figure 5:
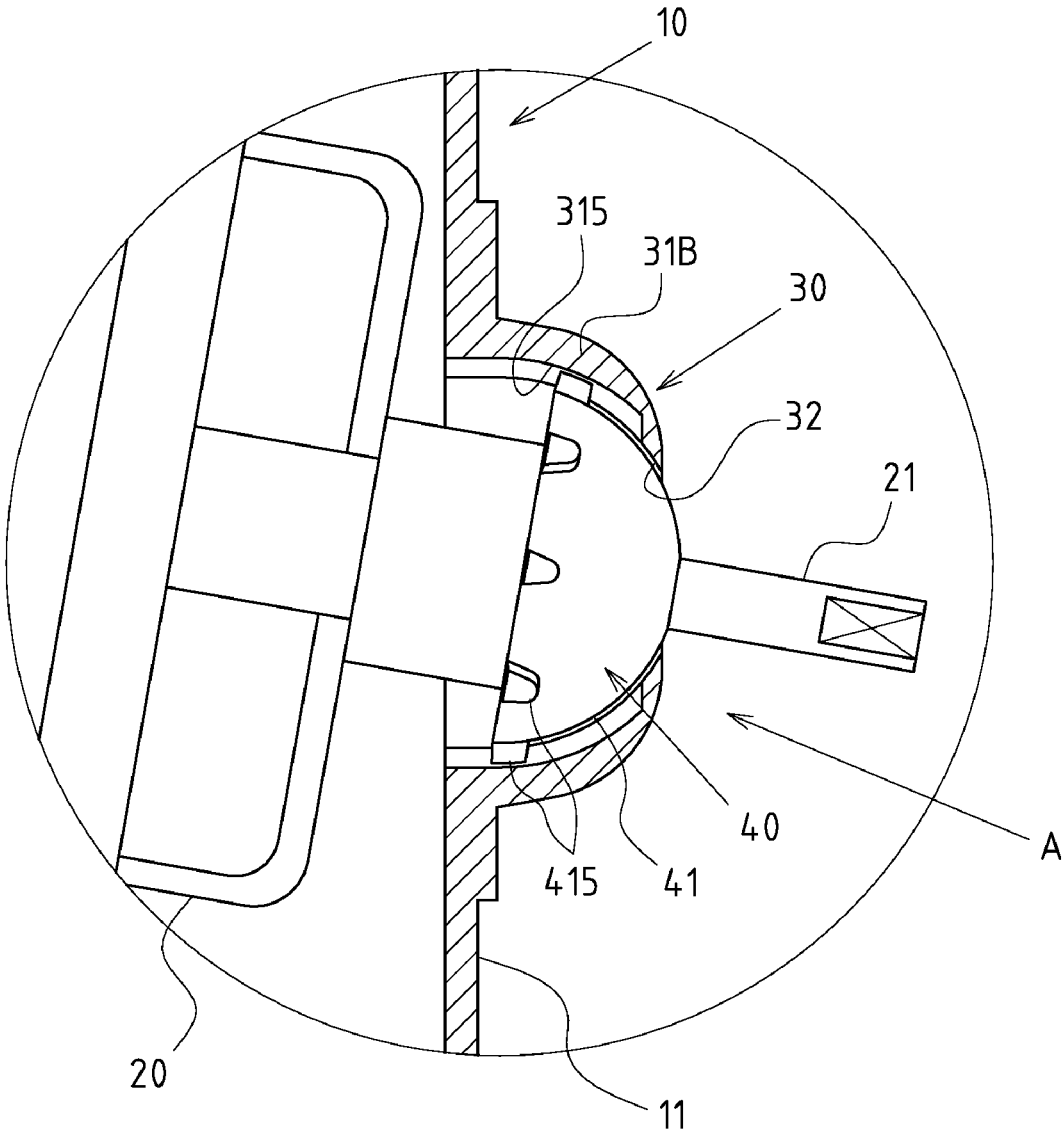
FIG. 5 depicts another sectional view of the application of the spherical supporting surface of the ball-and-socket support frame of the present invention.

At the inner side of the ball-and-socket support frame 30, there is a limit seat 60, which is provided with a coupling portion 61 and a through-hole 62 that can be located onto the front wall 11 of the main casing 10. The coupling portion 61 is made of a plurality of holes for sleeving the bolts. The aperture of through-hole 62 is smaller than the external diameter of spherical abut seat 40, thus preventing release of the spherical abut seat 40. Additionally, the limit seat 60 is not an essential element in the preferred embodiment. As shown in FIG. 5, the spherical supporting surface 31B of the ball-and-socket support frame 30 is a deeply recessed model, so that the spherical abut seat 40 could be adapted deeply without the need of limit seat 60.

Figure 4:
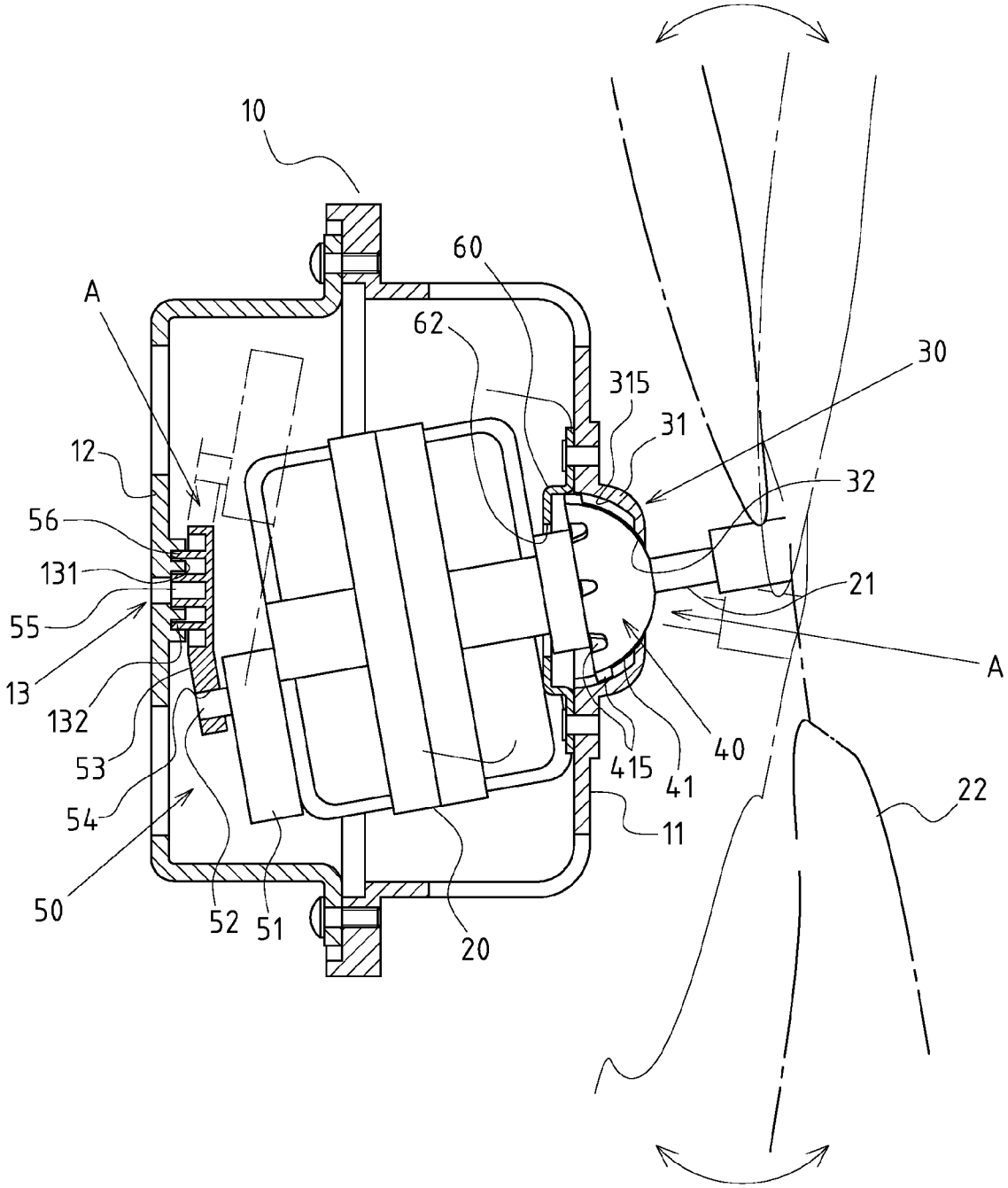
FIG. 4 depicts an assembled sectional view of the operation of the structure of the present invention.

Based on above-specified structures, the present invention is operated as follows:

Referring to FIG. 4, when the independent motor gearbox 51 of the crank linkage element 50 is activated to drive the rotation of the output shaft 52, the drive plate 53 will be rotated, enabling the second end 52 of the crank linkage element 50 to generate circular rotation, and the drive motor 20 along with axle center 21 to generate axially oblique circulating oscillation. When the main casing 10 of the rotary fan B is not mobilized, the rotary vane 22 will generate axially oblique circulating oscillation so as to change automatically the outlet's wind direction. Moreover, the wind direction of the rotary vane 22 changes uniquely along a circular path, making it possible to increase the wind outlet surface at any direction. On the other hand, when the drive motor 20 along with the axle center 21 generates axially oblique circulating oscillation, the front end of the drive motor 20 can be abutted with the spherical abut surface 41 of the spherical abut seat 40, and then mate with the spherical supporting surface 31 of the ball-and-socket support frame 30 for a universally stable support.

Figure 6:
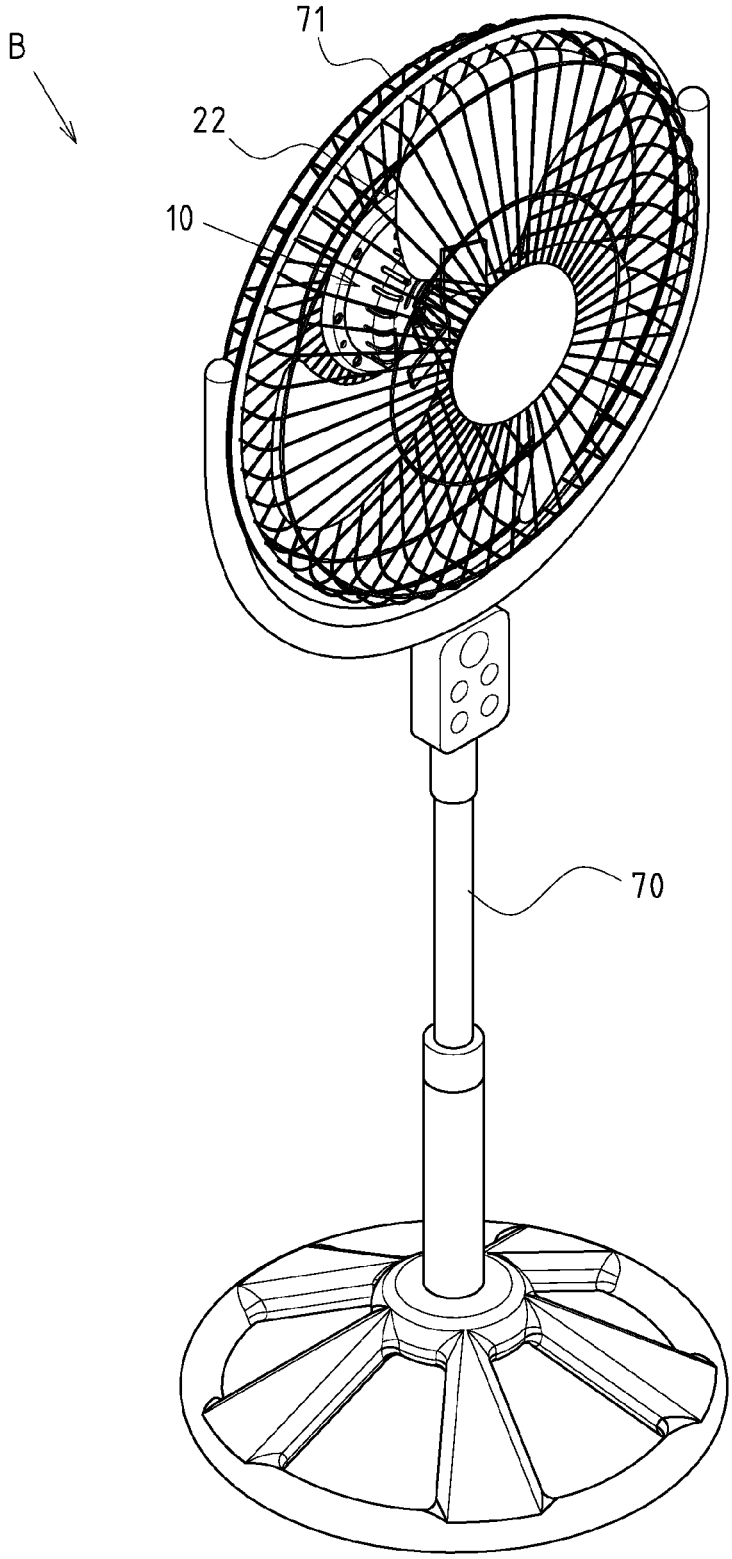
FIG. 6 depicts a perspective view of the first outside application of the rotary fan of the present invention.
Figure 7:
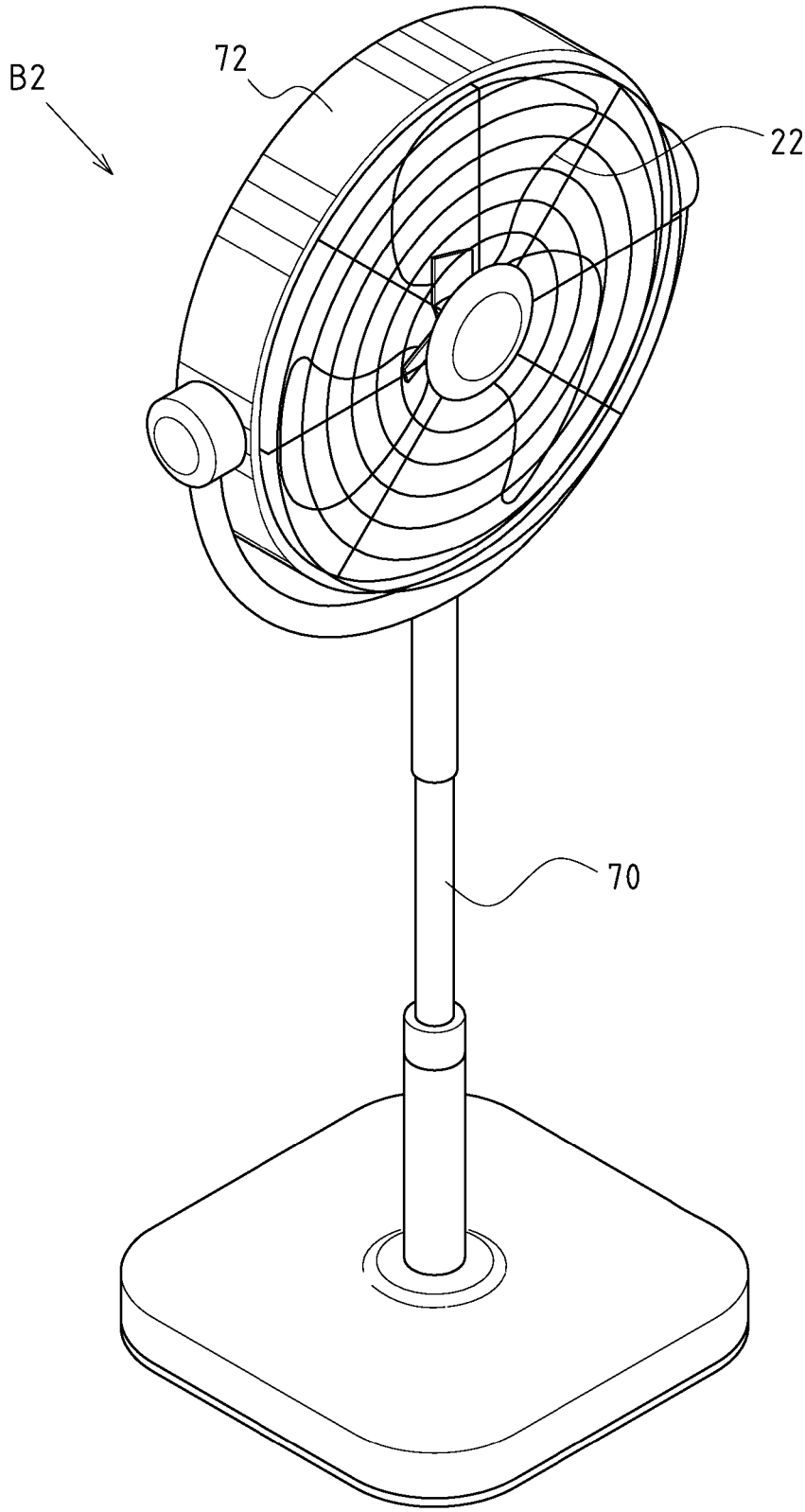
FIG. 7 depicts a perspective view of the second outside application of the rotary fan of the present invention.

The rotary fan of the present invention is available with several preferred embodiments according to the operational functions. Referring to FIG. 6, the rotary fan B is a standing draft fan, which is provided with a vertically extending rack 70. The draft fan means the outer casing for the rotary vane 22 has a grid structure 71. Referring also to FIG. 7, the rotary fan B2 is a standing rotating fan. The rotating fan means the outer casing for the rotary vane 22 has a tubular diversion box 72, enabling the air flow to concentrate on the outlet direction for an improved effect.

Figure 8:
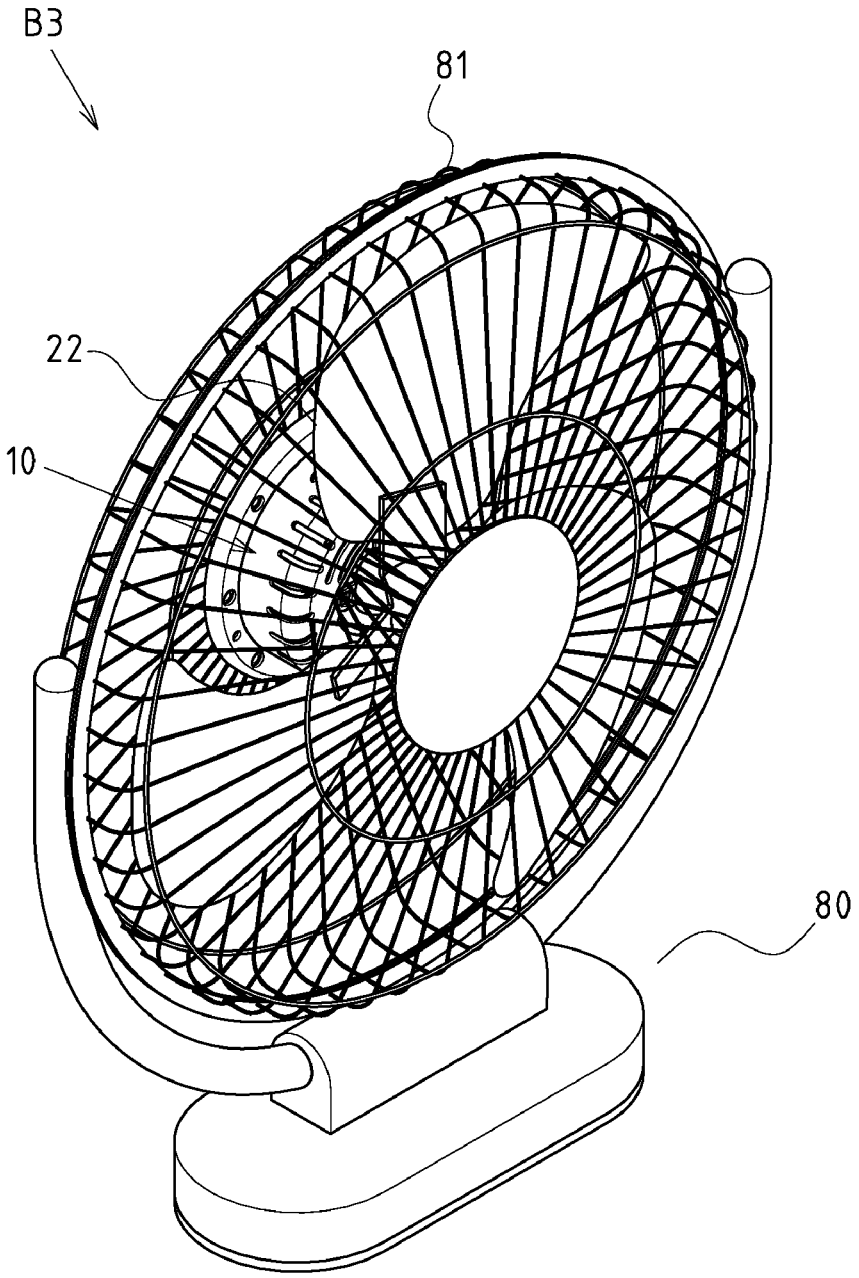
FIG. 8 depicts a perspective view of the third outside application of the rotary fan of the present invention.
Figure 9:
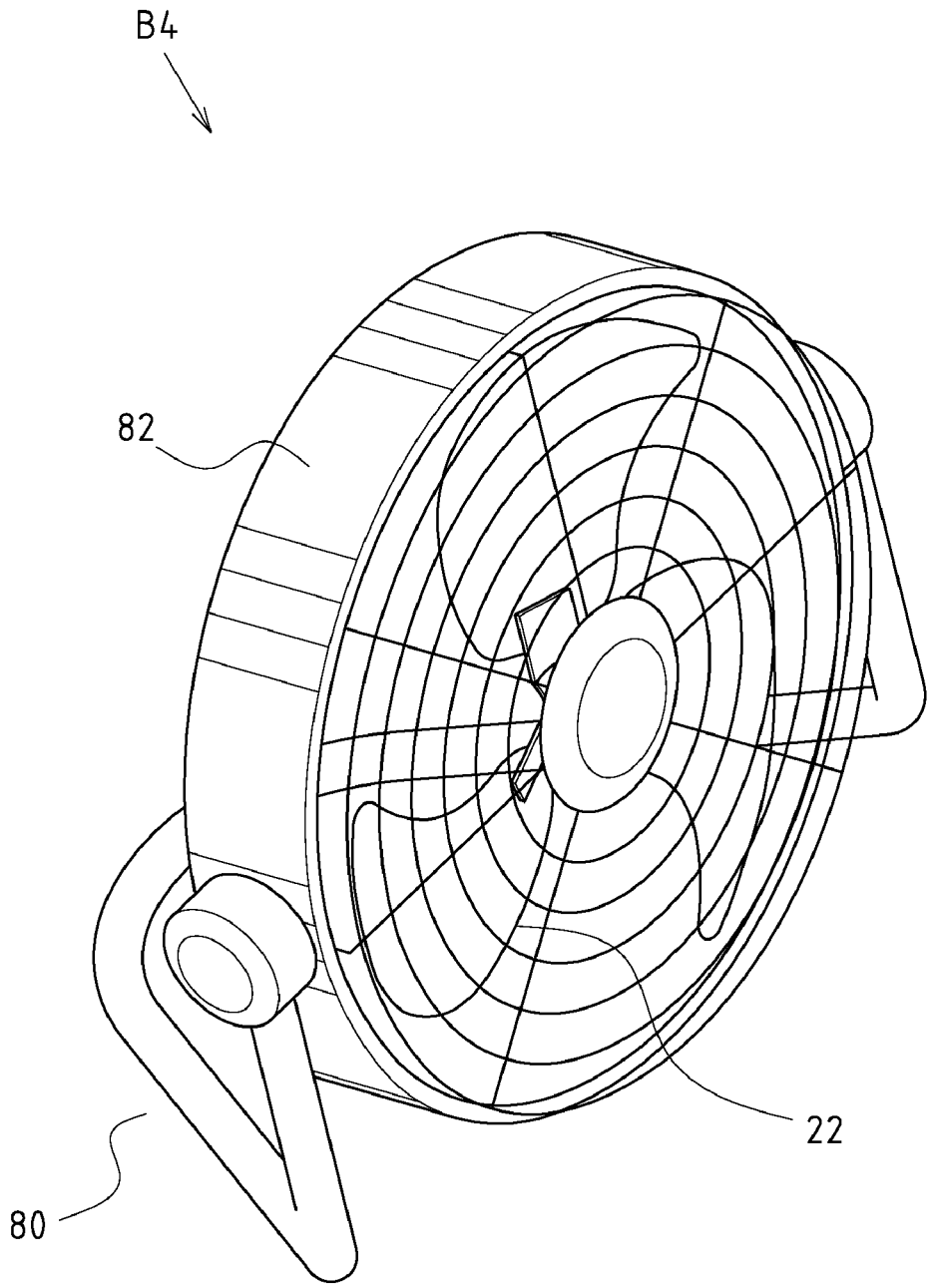
FIG. 9 depicts a perspective view of the fourth outside application of the rotary fan of the present invention.

Referring to FIG. 8, the rotary fan B3 is a seated draft fan, which is provided with a pedestal 80, and the outer casing for the rotary vane 22 has a grid structure 81. Referring also to FIG. 9, the rotary fan B4 is a seated rotating fan, and the outer casing for the rotary vane 22 has a tubular diversion box 82, enabling the air flow to concentrate on the outlet direction for an improved effect.

Figure 10:
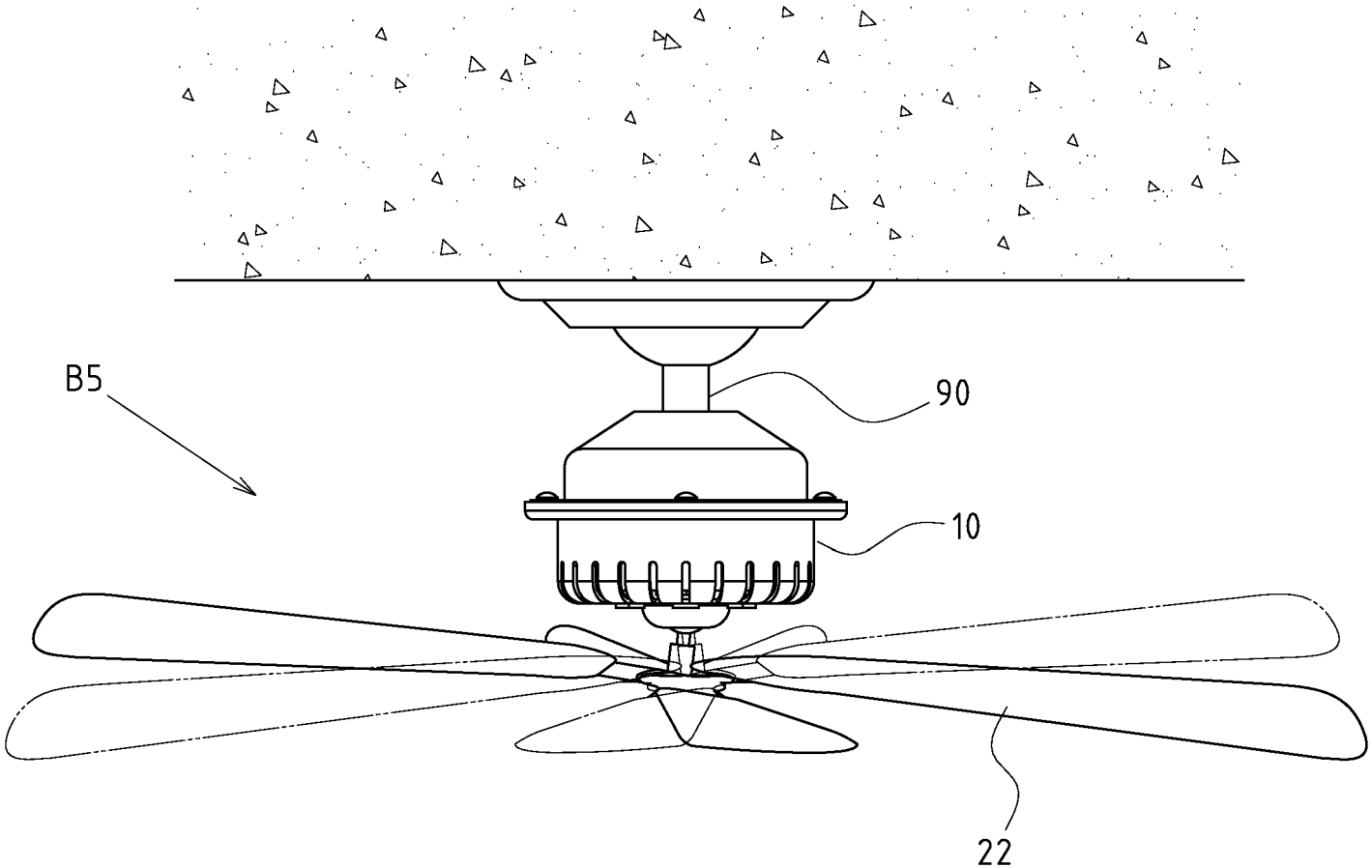
FIG. 10 depicts a side elevation view of the fifth outside application of the rotary fan of the present invention.

Referring also to FIG. 10, the main casing 10 of the rotary fan B5 is provided with a hanger portion 90, such that the rotary fan B5 is under a suspended state, namely, the rotary fan B5 could be assembled under the ceiling with the configuration of the hanger portion 90 (i.e. ceiling fan).

I claim:

1. A built-in swing mechanism of a rotary fan, said rotary fan having a main casing, a drive motor with an axle center, and a rotary vane, said drive motor and said rotary vane being driven to generate axially oblique circulating oscillation, said built-in swing mechanism comprising:

a ball-and-socket support frame, arranged onto a front wall of the main casing correspondingly to the axle center of the drive motor, said ball-and-socket support frame being provided with a spherical supporting surface and a through-hole located at a center of a spherical supporting surface, said through-hole being in threaded engagement with the axle center of the drive motor;

a spherical abut seat, being fastened at a front end of the drive motor and being provided with a spherical abut surface coupled with said spherical supporting surface of the ball-and-socket support frame;

a punch hole being placed at the center of said spherical abut surface and being penetrated into said axle center of the drive motor; and a crank linkage element, being assembled between a rear end of the drive motor and a rear wall of the main casing and having a first end driven to enable oscillation of a second end, said second end being assembled at a rotary pivot correspondingly to the rear wall of the main casing.

2. The built-in swing mechanism defined in claim 1, further comprising:

a plurality of bulges and troughs arranged at intervals between said spherical abut surface of the spherical abut seat and said spherical supporting surface of the ball-and-socket support frame.

3. The built-in swing mechanism defined in claim 1, further comprising:

a limit seat being placed at an inner side of the ball-and-socket support frame and being provided with a coupling portion and a through-hole located onto the front wall of the main casing, said through-hole having an aperture smaller than an external diameter of said spherical abut seat, preventing release of the spherical abut seat.

4. The built-in swing mechanism defined in claim 1, wherein the first end of the crank linkage element comprises an independent motor gearbox, being provided with an output shaft, wherein the second end of the crank linkage element comprises a laterally protruding drive plate, having one end provided with an axle hole sleeved at the output shaft of the motor gearbox; and another end provided with a protruding column and a sleeving ring, the main casing having a rotary pivot with a mating pivot seat hole and a circular groove.

* * * * *